US005092256A

United States Patent [19]

Kojima

[11] Patent Number: 5,092,256

[45] Date of Patent: Mar. 3, 1992

[54] METHOD FOR SEWING ON BUTTONS AND WRAPPING NECK THREAD IN A BUTTON SEWING MACHINE

[75] Inventor: Toshihiko Kojima, Hyogo, Japan

[73] Assignee: Yamato Mishin Seizo Kabushiki Kaisha, Osaka, Japan

[21] Appl. No.: 562,383

[22] Filed: Aug. 2, 1990

Related U.S. Application Data

[63] Continuation-in-part of Ser. No. 488,372, Feb. 23, 1990, abandoned, which is a continuation of Ser. No. 191,022, May 3, 1988, abandoned.

[30] Foreign Application Priority Data

May 11, 1987 [JP] Japan ..... 62-115512
Oct. 2, 1987 [JP] Japan ..... 62-250436

[51] Int. Cl.[5] ..... D05B 3/14

[52] U.S. Cl. ..... 112/112; 112/121.12; 112/265.1

[58] Field of Search ..... 112/112, 111, 121.12, 112/110, 108, 265.1

[56] References Cited

U.S. PATENT DOCUMENTS 4,221,179 9/1980 Miyao et al. ..... 112/111 X
4,712,493 12/1987 Aso et al. ..... 112/112
4,854,252 8/1989 Asao et al. ..... 112/112 X
4,884,517 12/1989 Asao et al. ..... 112/112

*Primary Examiner*—Werner H. Schroeder
*Assistant Examiner*—Paul C. Lewis
*Attorney, Agent, or Firm*—Wenderoth, Lind & Ponack

[57] ABSTRACT

A button sewing machine includes a table which is reciprocated, and which is moved at a right angle to the direction of reciprocation by use of motors, instead of by a mechanical movement and a ROM (read-only memory) as found in conventional machines. The desired changes in stitch number and, in particular, a button sewing on pattern, are controlled automatically by making use of an electronic control device. Needle drop positions at which a deep stitch (show stitch) and a shallow stitch (ordinary stitch) are to be carried out are established by the use of two cylinders. Once a neck thread is sewn, during forward movement of the table the middle of the neck thread is wrapped and then during rearward movement of the table the outside of the neck thread is wrapped, or, the outside of the neck thread is wrapped during the forward movement and the middle of the neck thread is wrapped during the rearward movement, or only the outside of the neck thread is wrapped during both the forward movement and the rearward movement of the table. Then, as a last step, the wrapped or bunched part is subject to end stitching. This apparatus dispenses with the replacement of cams and ROMs that wear out in conventional sewing machines.

4 Claims, 11 Drawing Sheets

METHOD FOR SEWING ON BUTTONS AND WRAPPING NECK THREAD IN A BUTTON SEWING MACHINE

This application is a Continuation-In-Part of Ser. No. 07/488,372 filed Feb. 23, 1990, which is in turn a Continuation of Ser. No. 07/191,022 filed May 3, 1988 and now abandoned.

BACKGROUND OF THE INVENTION

1. Field of the Invention

This invention relates to a method of and apparatus for sewing on buttons and wrapping neck thread automatically and accurately by utilizing an electronic control device, in a button sewing machine.

2. Description of the Related Art

Conventionally, a button sewing machine performs two procedures, namely, a first procedure of sewing a pattern to secure buttons on cloth with a neck thread by utilizing cams and other parts associated with each such pattern and a second procedure of wrapping a thread around the neck thread.

Prior art electric sewing machines capable of changing sewing patterns are disclosed in Japanese Patent Application Publications No. 58-58119 and No. 62-48510, for example. However, since these sewing machines adopt ROM (read-only memory) which is programmable, a large quantity of ROM is required for changing a button sewing-on pattern according to the kinds of buttons, cloths, or threads.

Although memory of a large capacity is available at the present time, it is not practical for use in a button sewing machine because too much labor is required to program the ROM with combinations of data representative of machine control commands for carrying out all of the various sewing patterns. In addition, in the case where a new sewing pattern has been created, the ROM would have to be replaced with a new one.

Further, when a button is sewn mechanically on a cloth by such conventional sewing machines using a cam device and other means, a wrapping thread is wrapped only around the outside of the neck thread and therefore such problems as the neck thread getting loose and skip stitches are likely to occur. Moreover, whenever the predetermined stitch number must be changed owing to a change in the sewing pattern, the sewing machine must be disassembled to exchange cams and other parts. This is not only troublesome and inefficient but also involves costs associated with the time and labor for disassembling and reassembling the sewing machine. Furthermore, according to the change of sewing pattern, the ROM containing machine control information for the button sewing-on pattern must be changed. This requires not only time and labor associated with such a change but also requires maintaining an inventory of ROM covering all kinds of sewing patterns. Thus, this also involves unnecessary expenses, time and labor.

SUMMARY OF THE INVENTION

In view of the above disadvantages of the conventional button sewing machines, the present invention has as its object to provide a button sewing machine in which only basic machine control information is stored in a ROM which is programmable, particular data of button sewing-on patterns are input to a control unit and by such data stepping motors reciprocate a table of the machine to facilitate the sewing-on pattern. By this arrangement, the button sewing on pattern can be changed easily even in the case where there is a large quantity of parameters used in various combinations to establish such a sewing pattern, namely, parameters associated with various kinds of buttons (4-holes, 2-holes, shank-button), the particular sewing pattern for sewing on the button (4-holes parallel, 4-holes cross), the button hole stitch number, the neck thread stitch number, whether a show stitch is to be made, the depth of a show stitch, etc. A show stitch refers to a first stitch which is passed through a back cloth to prevent the separation of face cloth from the back cloth.

BRIEF DESCRIPTION OF THE DRAWINGS

The accompanying drawings illustrate a preferred embodiment of the present invention, in which.

DETAILED DESCRIPTION OF THE PREFERRED EMBODIMENT

Figure 3:
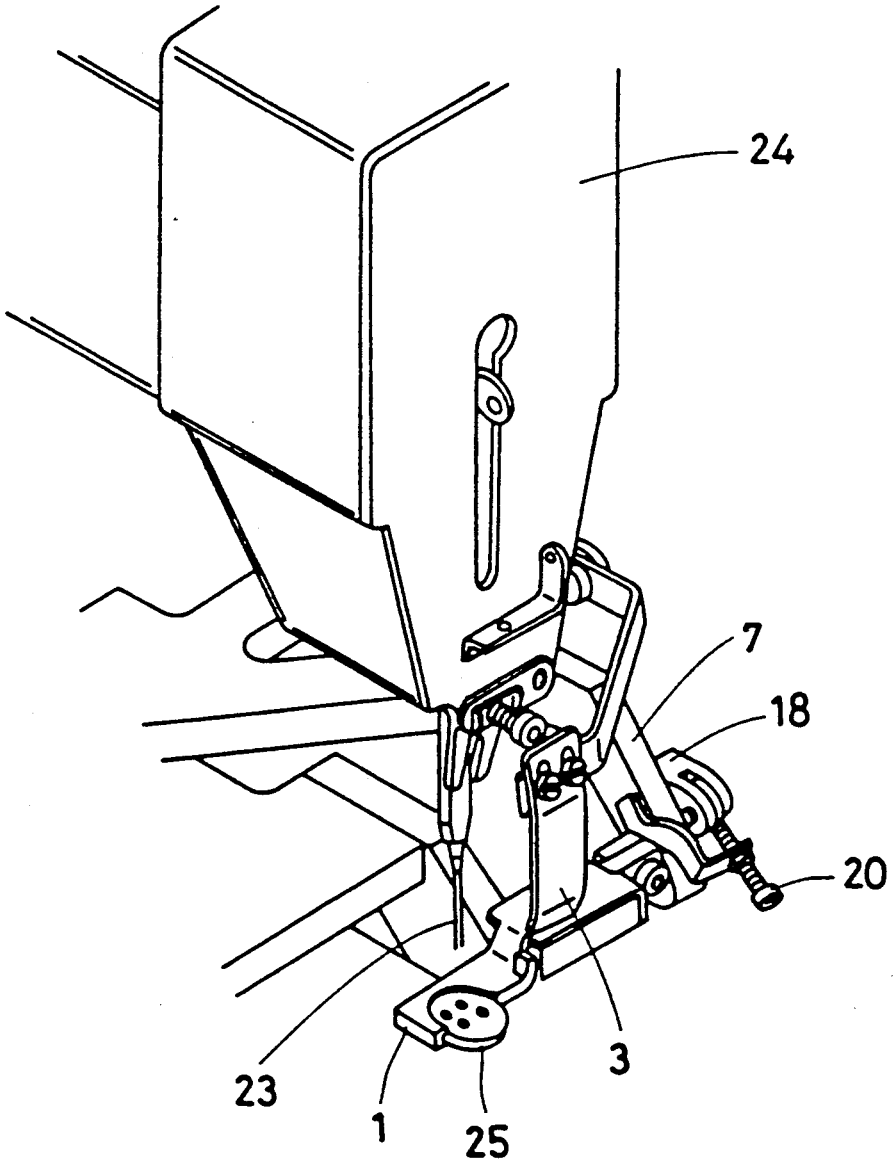
FIG. 3 is another perspective view of the sewing machine, showing a button fitted in a button holder so as to be ready for being sewed on a cloth or cloths.
Figure 4:
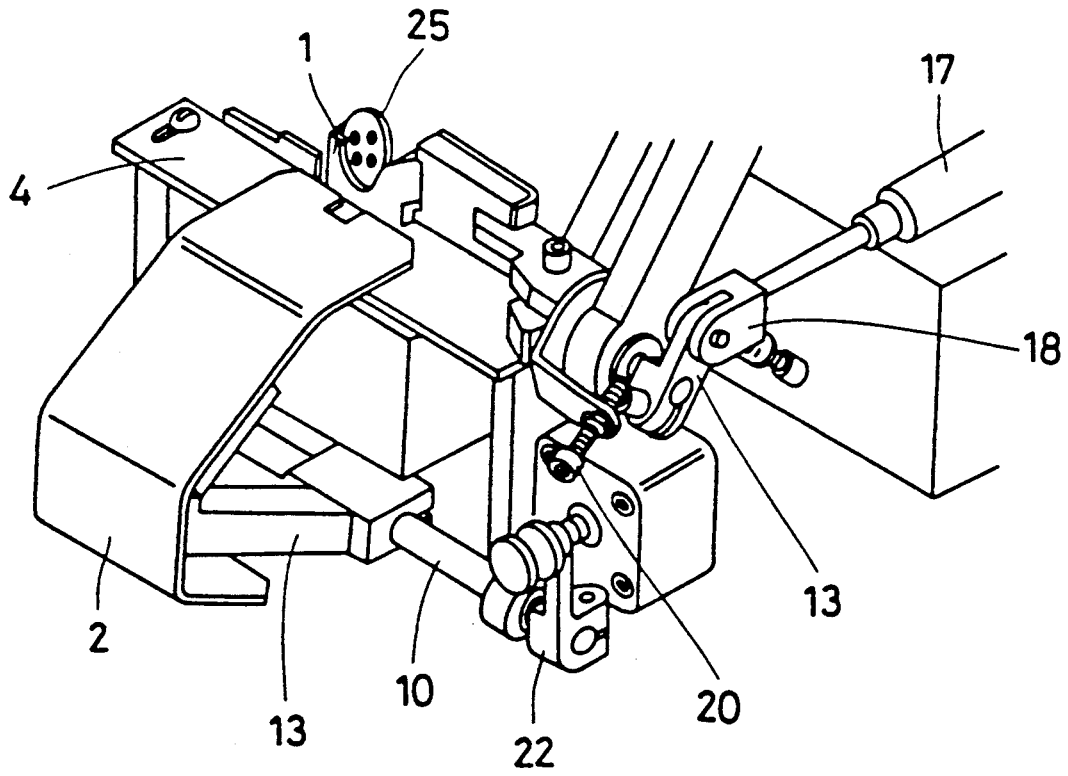
FIG. 4 is yet another perspective view of the sewing machine, showing the button holder in a vertical state whereby a wrapping thread may be wrapped around a neck thread that has been sewn to secure the button to a cloth or cloths.

Reference numeral 1 designates a button holder. An end of the button holder 1 is fitted to an arm 19 through the medium of a cloth holder arm 7. A top end of the arm 19 is connected to a connecting rod 18, to which a cylinder 17 for rotating the button holder 1 is in turn connected. More specifically, the cylinder 17 rotates the button holder 1 between the position (horizontal state) shown in FIG. 3, at which the sewing of a button 25 to a cloth with neck thread is to be carried out, and the position (vertical state) shown in FIG. 4 at which the wrapping of the neck thread 29 with a wrapping thread 30 is to be carried out. One side of the button holder 1 has a recess in which the button 25 is held and released by a spring (not shown) built in the recessed portion of the button holder 1.

Figure 5:
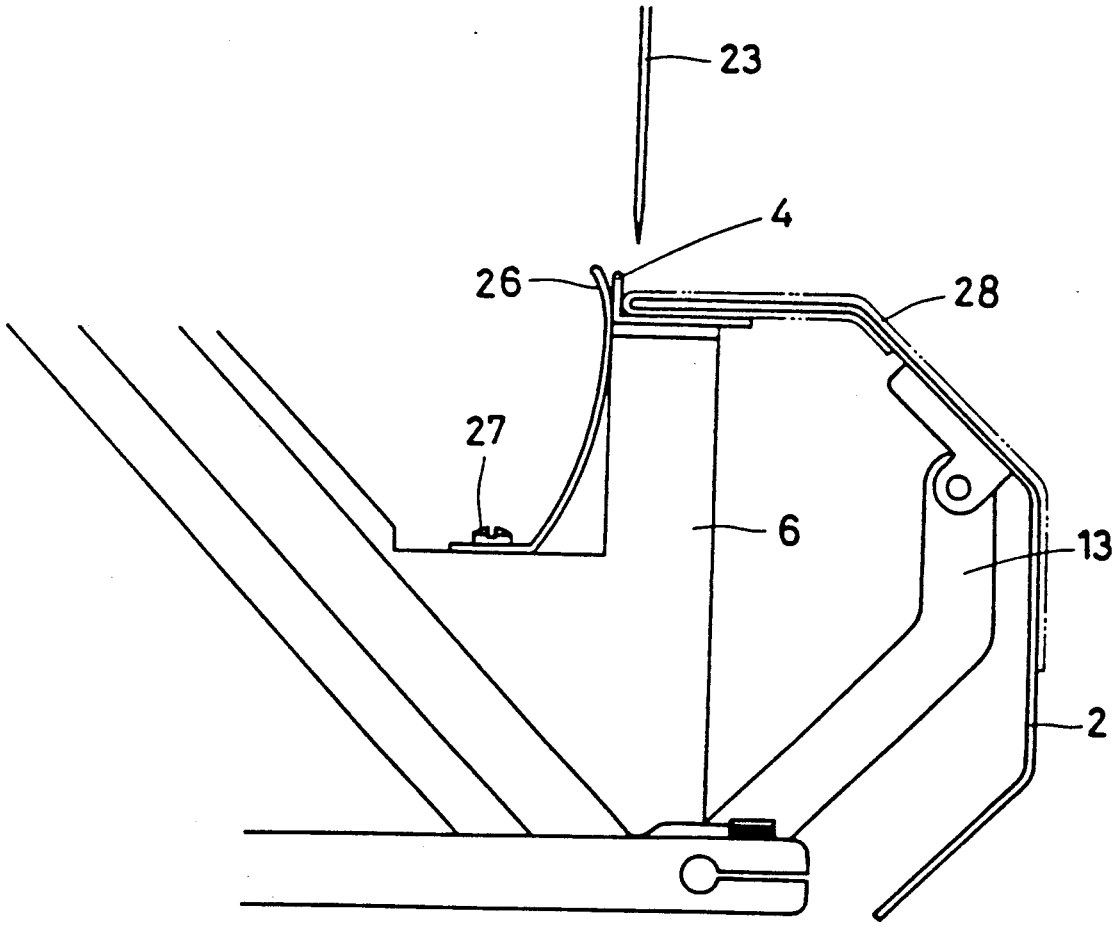
FIG. 5 is a side view of the sewing machine, showing the position of a cloth holder at which shallow stitching (ordinary stitch) is carried out.

Reference numeral 2 designates a cloth holder having a conventional throat plate 11 which is fixed to a bracket 13. This bracket 13 has a hole through which a shaft 10 extends. Both ends of the shaft 10 are loosely fitted into a pair of cloth holder arms 6 fixed to a table 5. After a cloth 28 is set on the cloth holder 2, the cloth holder 2 is moved below a conventional needle 23 to position the cloth at a needle drop position (FIG. 5). By operating a pedal (not shown) for driving the sewing machine, a fixed cylinder 8 operatively connected to the cloth holder 2 is actuated to press the cloth holder 2 toward a cloth guide 4 thereby fixing the cloth 28 relative to guide 4.

Reference numeral 3 designates a fabric presser which is fixed to an L-shaped connecting plate 3*a*. The end of this connecting plate 3*a* is connected, through a connecting rod, to a cloth pressing cylinder 21 mounted to a sewing machine arm 24. By operating the pedal for driving the sewing machine, the cloth pressing cylinder 21 is actuated and the fabric presser 3 descends, whereby the cloth 28 at the upper part of the cloth holder 2 is pressed against the throat plate 11 so that it does not slip during sewing.

The cloth guide 4 is mounted to the pair of cloth holder arms 6 fixed to the table 5. By actuating the fixed cylinder 8, the cloth holder 2 is pressed toward the cloth guide 4 to press the cloth 28 against guide 4 at the underside of the cloth holder 2.

The cloth holder arms 6 are fixed to the right and left sides of the table 5, respectively. The cloth holder arm 7 is mounted to the right end of the table 5. The table 5 is an X-Y table respectively movable back and forth and to the right and left by two stepping motors (not shown) operatively connected to X-Y table 5. By operating these two stepping motors, the cloth holder arms 6, the cloth holder arm 7, the cloth holder 2 and the button holder 1, attached to the table 5 can be selectively moved back and forth and to the right and left in accordance with a particular sewing pattern.

Fixed cylinder 8 is connected to a connecting rod 9 via a piston rod 8*a* (FIG. 13), and is also connected to the shaft 10 via a connecting arm 12*a*. By lowering or raising the piston rod 8*a*, cloth at the underside of the cloth holder 2 is pressed or released, respectively. As will be described later, a stopper 12 provided on connecting arm 12*a* sets the needle drop positions at which a deep stitch (show stitch) and a shallow stitch are to be carried out.

In sewing a front button to a suit, for example, it does not look appropriate for a neck thread to be exposed at the back cloth. Therefore, only the first stitch of the neck thread is passed through the back cloth for preventing the separation of face cloth from the back cloth. This first stitch is referred to herein as the "show stitch".

Reference numeral 14 designates a show stitch adjust screw mounted to the table 5. The end of the screw 14 is in contact with an arm 14*a* and by turning the screw 14 clockwise or counterclockwise, the position of the arm 14*a* is changed to limit downward movement of stopper 12 as arm 12*a* pivots downwardly to adjust the needle drop positions at which a deep stitch may be carried out.

Figure 6:
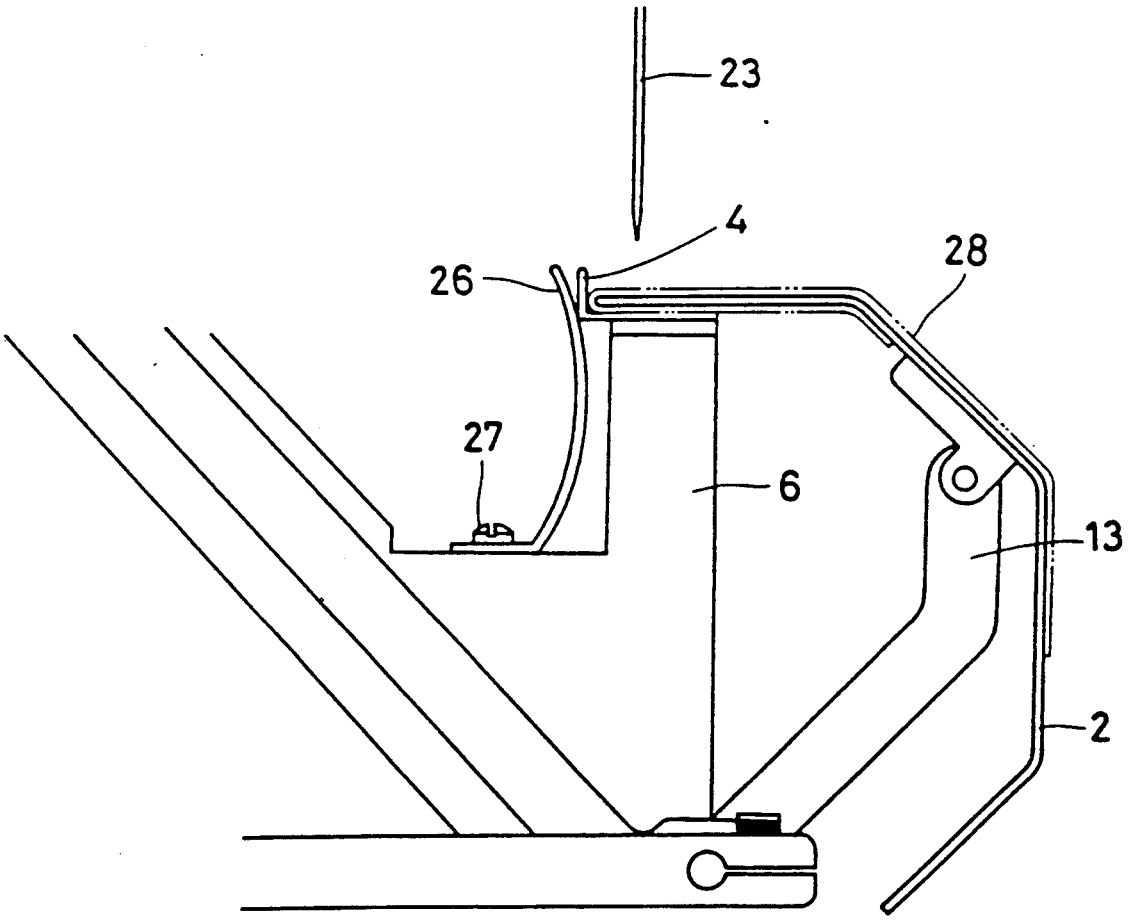
FIG. 6 is a side view of the sewing machine, showing the position of a cloth holder at which deep stitching (show stitch) is carried out.
Figure 13:
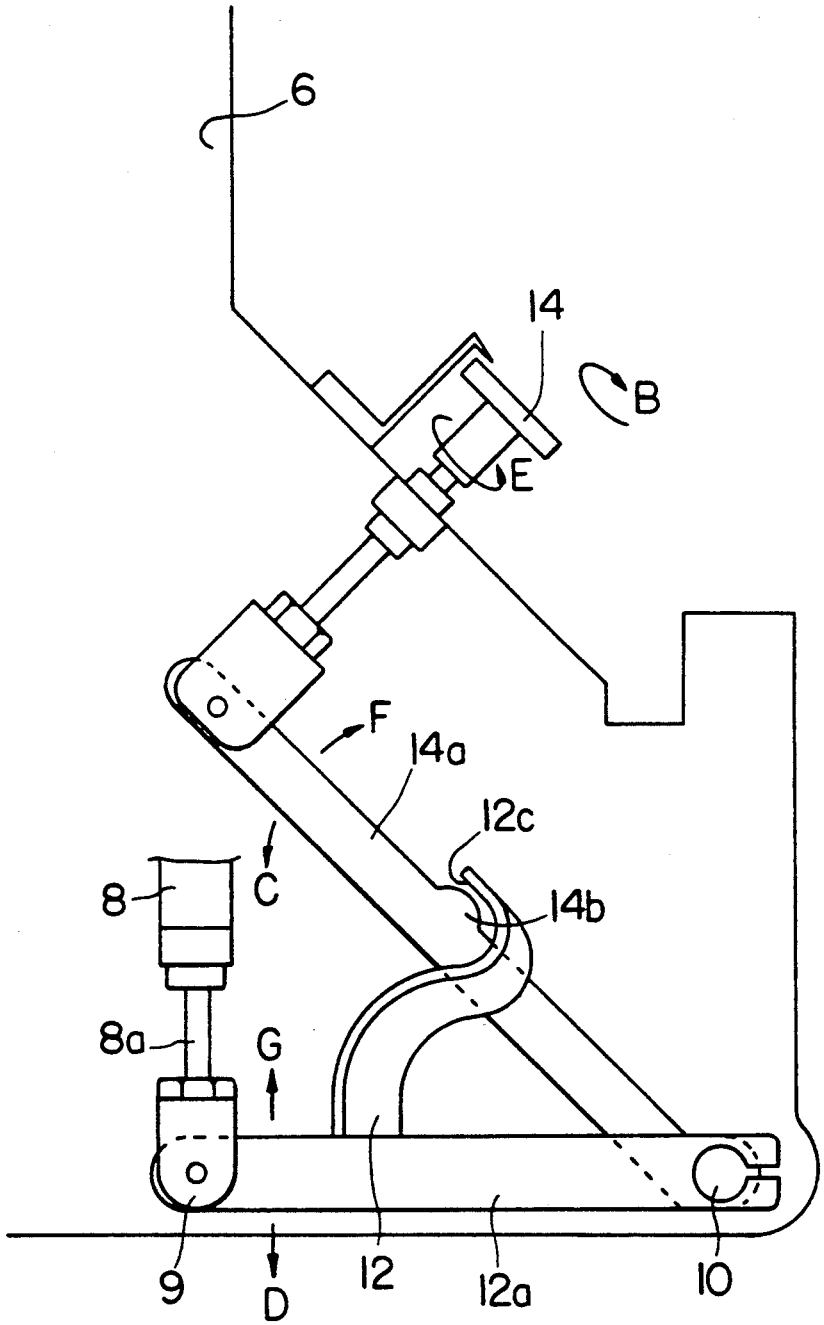
FIG. 13 is a side view of a mechanism for setting the position of a cloth holder at which deep stitching (the show stitch) is to be carried out, in the sewing machine according to the present invention.

More specifically, an explanation is made below as to how the cloth holder 2 is positioned as shown in FIG. 6 by the parts shown in FIG. 13 when deep stitching (the show stitch) is to be carried out.

Figure 1:
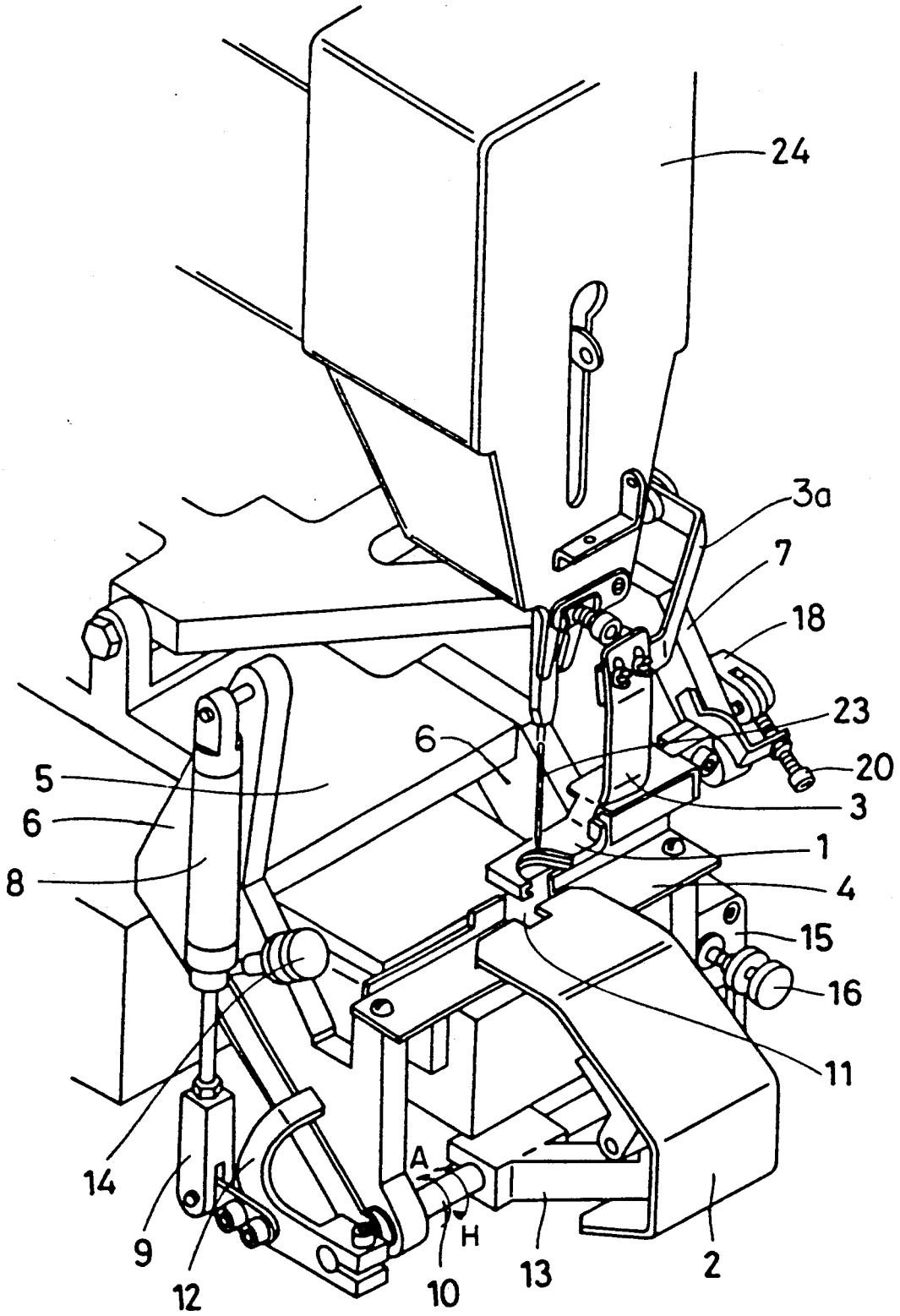
FIG. 1 is a perspective view, from the left, of a sewing machine for sewing buttons according to the present invention.

Arm 12*a* connected to the shaft 10 is moved counterclockwise by the action of the cylinder 8 via the piston rod 8*a* and the coupling rod 9. At this time, the underside 12*c* of the stopper 12 contacts a projection 14*b* of the arm 14*a*. Concurrently, the cloth holder 2 fitted to the bracket 13 which is fixed to the shaft 10 turns in the direction of arrow A (FIG. 1), whereby the cloth holder 2 moves to the position shown in FIG. 6, namely, to the needle drop position at which deep stitching (show stitch) is carried out.

The adjustment of the position at which deep stitching (show stitch) is carried out is effected by the show stitch adjust screw 14. When the screw 14 is turned in the direction of arrow B (clockwise direction), the arm 14*a* is lowered in the direction of arrow C and therefore a space is left between the projection 14*b* of the arm 14*a* and the underside 12*c* of the stopper 12, whereby the arm 12*a* can be swung in the direction of arrow D by the action of the cylinder 8. In synchronism with this swinging of the arm 12*a*, the shaft 10 fixed to the arm 12*a* rotates in the direction of arrow A and the cloth holder 2 fitted to the bracket 13 moves to a position at which the deep stitching is to be carried out by the degree to which the show stitch adjust screw 14 has been turned in the direction of arrow B (clockwise direction).

Once the piston rod 8*a* has been retracted so as to move arm 12*a* in the direction of arrow G thereby rotating shaft 10 in the direction of arrow H, the show stitch adjust screw 14 can be turned, on the other hand, in the direction of arrow E (counterclockwise direction) so that the arm 14*a* is raised in the direction of arrow F and the space between the projection 14*b* of the arm 14*a* and the underside 12*c* of the stopper 12 is reduced. Then again, the arm 12*a* can be swung in the direction of arrow D by the operation of a pedal to actuate cylinder 8 and extend piston rod 8*a*. In synchronism with this swinging of the arm 12*a*, the shaft 10 fixed to the arm 12*a* rotates in the direction of arrow A (FIG. 1), whereby the cloth holder 2 fixed to the bracket 13 moves the position at which deep stitching (the first stitch) is to be carried out corresponding to the degree to which the show stitch adjust screw 14 has been turned in the direction of arrow E (counterclockwise direction). In such a case, the show stitch will be shallower than when the show stitch screw has been rotated in the direction of arrow B.

Reference numeral 15 designates a show stitch cancelling cylinder which is fitted to a cloth holder arm. A piston rod 15*a* projects at the central part of the cylinder 15.

Reference numeral 16 designates a show stitch cancelling screw. The end of this screw 16 is aligned with the piston projecting at the central part of the cylinder 15 and by turning the screw 16 clockwise or counterclockwise, the needle drop position at and after the second stitch is established.

More specifically, an explanation is made below as to how the cloth holder 2 is positioned as shown in FIG. 5 when the shallow stitching is to be carried out after the show stitch, with reference to FIG. 14 and FIG. 15.

Figure 14:
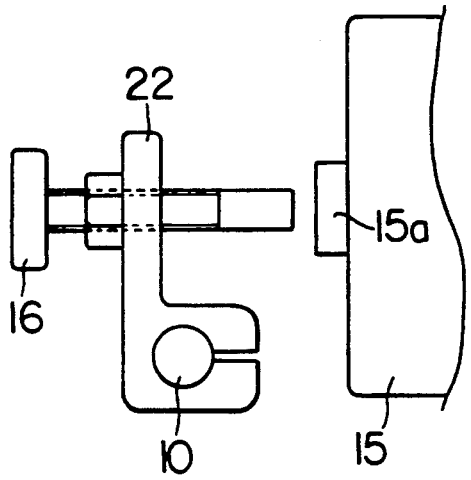
FIGS. 14 and 15 are side views of a mechanism for moving the cloth holder to a new position once a show stitch is carried out thereby cancelling the action of the mechanism shown in FIG. 13, in the sewing machine according to the present invention.
Figure 15:
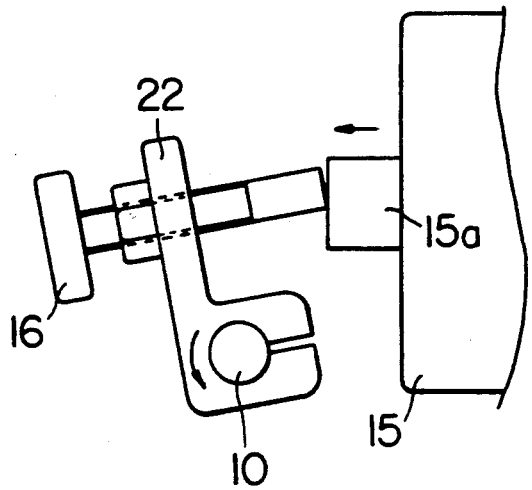

The piston rod 15*a* of the show stitch releasing cylinder 15 assumes a standby state as shown in FIG. 14 while the deep stitching (show stitch), namely, the first stitch, is carried out. When the deep stitching (show stitch) is completed, the cylinder 15 begins to act while the cylinder 8 continues to act on shaft 10 as limited by stopper 12. Namely, the rod 15*a* of the cylinder 15 is extended from the position shown in FIG. 14 to a position (FIG. 15) which has been preset for changing the position of the cloth holder 2 to one at which the shallow stitching is to be carried out. At this time, the rod 15*a* contacts a forward end of the show stitch releasing adjust screw 16 and presses the screw 16, whereupon the position of the cloth holder 2 fixed to the bracket 13 which is fixed to the shaft 10 is changed from the one at which the deep stitching is carried out to the one at which the shallow stitching is to be carried out. Thus, the cloth held by cloth holder 2 may be easily placed in respective positions to be subjected to both deep stitching and shallow stitching.

Reference numeral 20 designates a stopper which is fitted to the button holder arm 7. An end of the stopper 20 is in contact with a projection of the arm 19. By turning the stopper 20 clockwise or counterclockwise, exact orientation of the button holder 1 in the horizontal state or the vertical state of the button holder is established.

Reference numeral 24 designates a sewing machine arm.

Reference numeral 26 designates a spring which is fixed to the table 5 by a screw 27. This spring normally presses the guide 4 toward the cloth holder 2.

Figure 7:
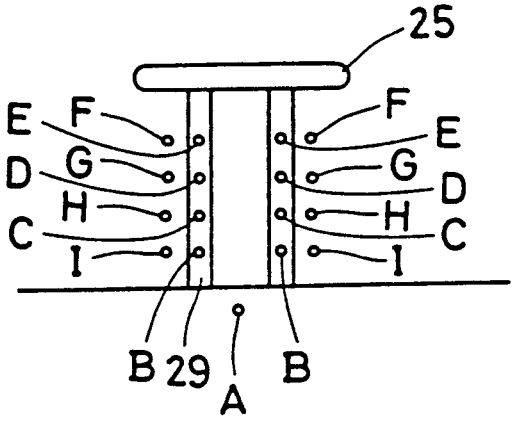
FIG. 7 is a front view of a button sewn on a cloth, showing the sequence in which a wrapping thread is wrapped around a neck thread.
Figure 8:
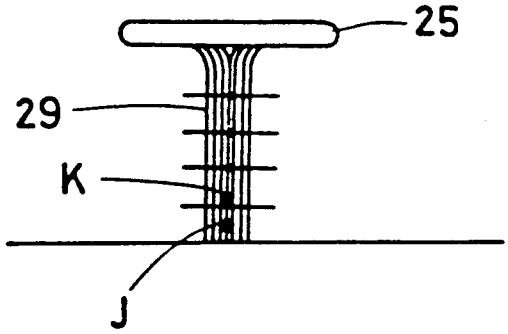
FIG. 8 is a front view of a button sewn on a cloth, showing the needle drop positions of an end stitching operation at which the end of a neck wrapping thread is forced into the middle of a neck thread.
Figure 9:
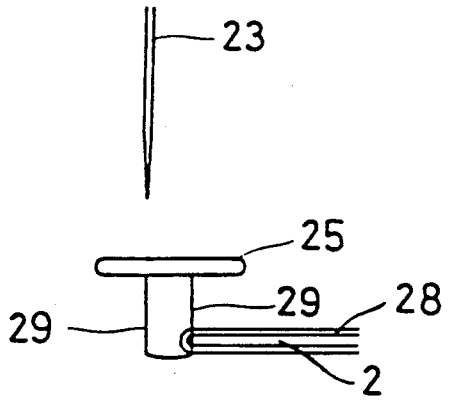
FIG. 9 shows a button being sewn on cloth.
Figure 10:
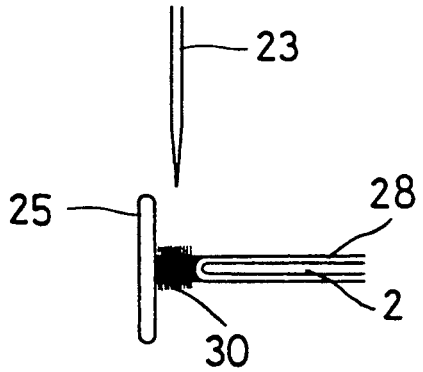
FIG. 10 shows a neck thread being wrapped with a wrapping thread.
Figure 11:
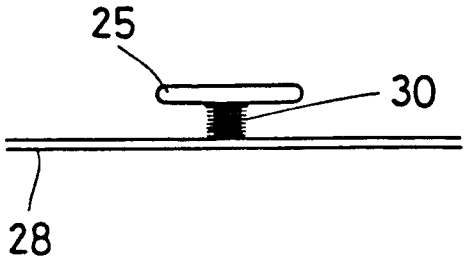
FIG. 11 shows a button for which the wrapping of the neck thread has been finished.

Reference letters A-K designate needle drop (stitching) positions for the neck wrapping thread as best seen in FIG. 7. Reference letters J and K in FIG. 8 designate the needle drop positions at which "end stitching" is carried out (end stitching being a finishing step in which the free end of the wrapping thread is pushed into the middle of the neck thread so as to prevent fraying of the wrapping thread at the free end). J represents the first position of end stitching. K is the last part of end stitching where the second stitch of end stitching is pushed into the middle of the neck thread 29, and by the tension created during the wrapping of the neck thread, the end is held therein.

The operation of the apparatus according to the present invention will now be described in more detail.

A button 25 is set in the button holder 1. A cloth is set on the cloth holder 2 and is pushed into the innermost part of the cloth guide 4. Then, the cloth holder fixing cylinder 8 is actuated upon the operation of a pedal, whereby the cloth holder 2, together with the cloth, is pressed on the surface of the cloth guide 4. At the same time, the cloth presser 3 presses the cloth under the control of the cloth presser cylinder 21 and the sewing machine starts operating. After the first stitch (show stitch) is sewn, the show stitch releasing cylinder 15 starts operating whereby the cloth holder 2 backs toward the operator (moves from the position shown in FIG. 6 to the position shown in FIG. 5).

A feeding device (not shown) operatively connected between table 5 and the stepping motors can be used for moving the button 25 to be sewn relative to the sewing thread. Table 5 is moved to move button holder 1, based on preset buttonhole positions in the X- and Y-directions, relative to the vertically reciprocating sewing needle. Thus, various kinds of buttons (e.g., 2-hole, 4-hole [cross], and 4-hole [parallel]) can be used.

Figure 2:
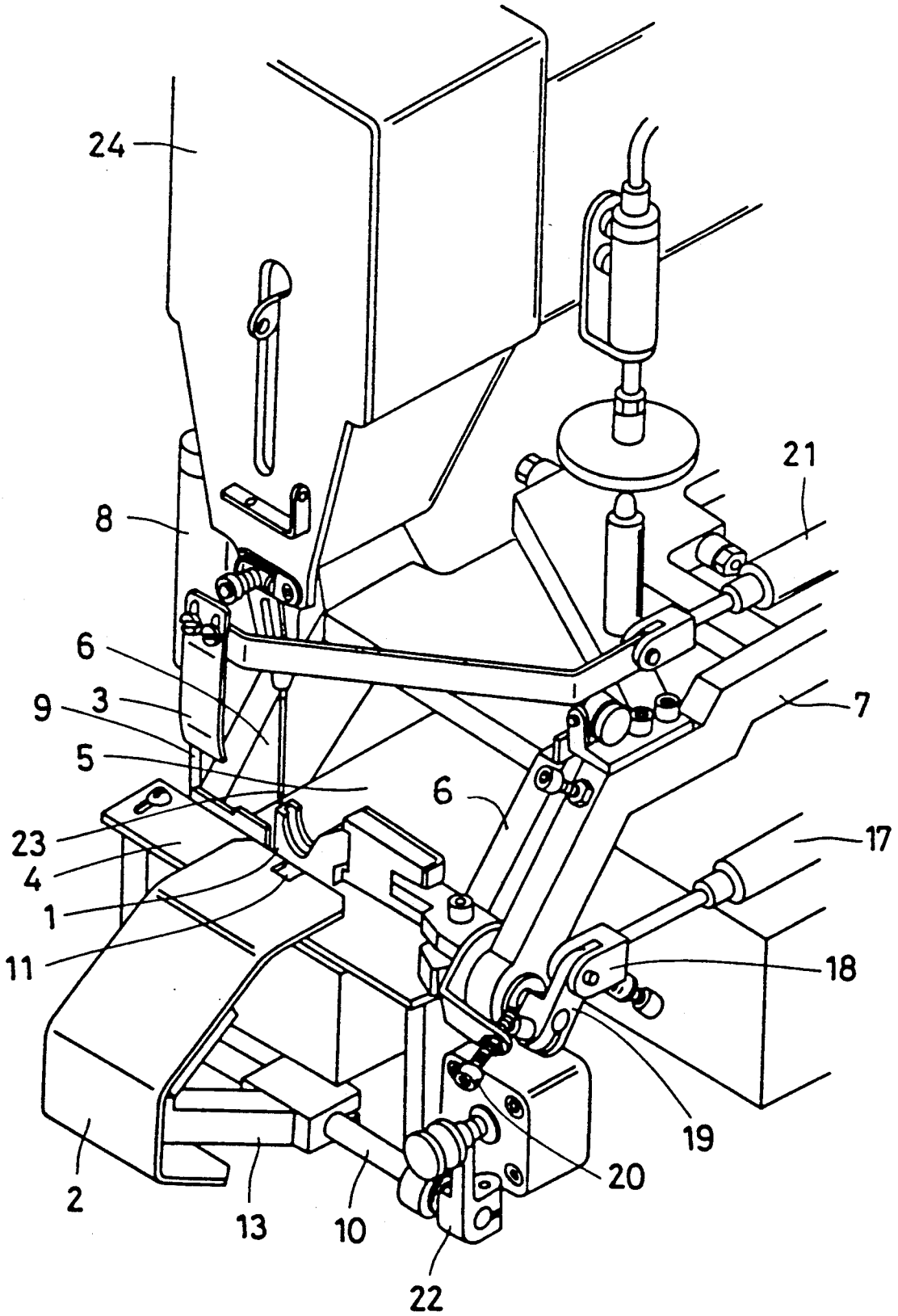
FIG. 2 is a perspective view, from the right, of the sewing machine, showing a vertical state of a button holder.

From the second stitch on, the table 5 moves toward the operator so that a needle 23 will drop through button holes, for example on the right side of a four hole button 25 and the button attaching process starts. Upon completion of a predetermined number of stitches, the needle 23 stops at the upper dead point and thread is cut by the action of a conventional thread cutting knife (not shown), whereupon the table 5 is moved leftward to sew through button holes on the left side and start the next button attaching process. Upon finishing the designated number of stitches, as a result of which neck threads 29 are provided, the needle 23 stops again at the upper dead point of the reciprocating travel of the needle. After the thread has been cut by the action of the thread cutting knife, the button holder 1 in a horizontal state (FIG. 1) is turned to a vertical state (FIG. 2), ready for the neck thread wrapping process, by the button holder rotating cylinder 17 and the first stitch (A) is carried out. In order to ensure perfect sewing makeup, after the first stitch in the cloth, a predetermined number of stitches is sewn on the middle (B-E) or the outside (F-I) of neck thread during a forward movement of the table 5, and then on the outside (F-I) or the middle (B-E) of neck thread during a backward movement of the table 5. Lastly, end stitching (J, K) is carried out on the wrapped and bunched part, and a needle thread is then cut by the needle cutting knife three times. In this embodiment, button attaching is explained with respect to a 4-hole button but the attaching of various kinds of buttons is possible according to the present invention.

Figure 12:
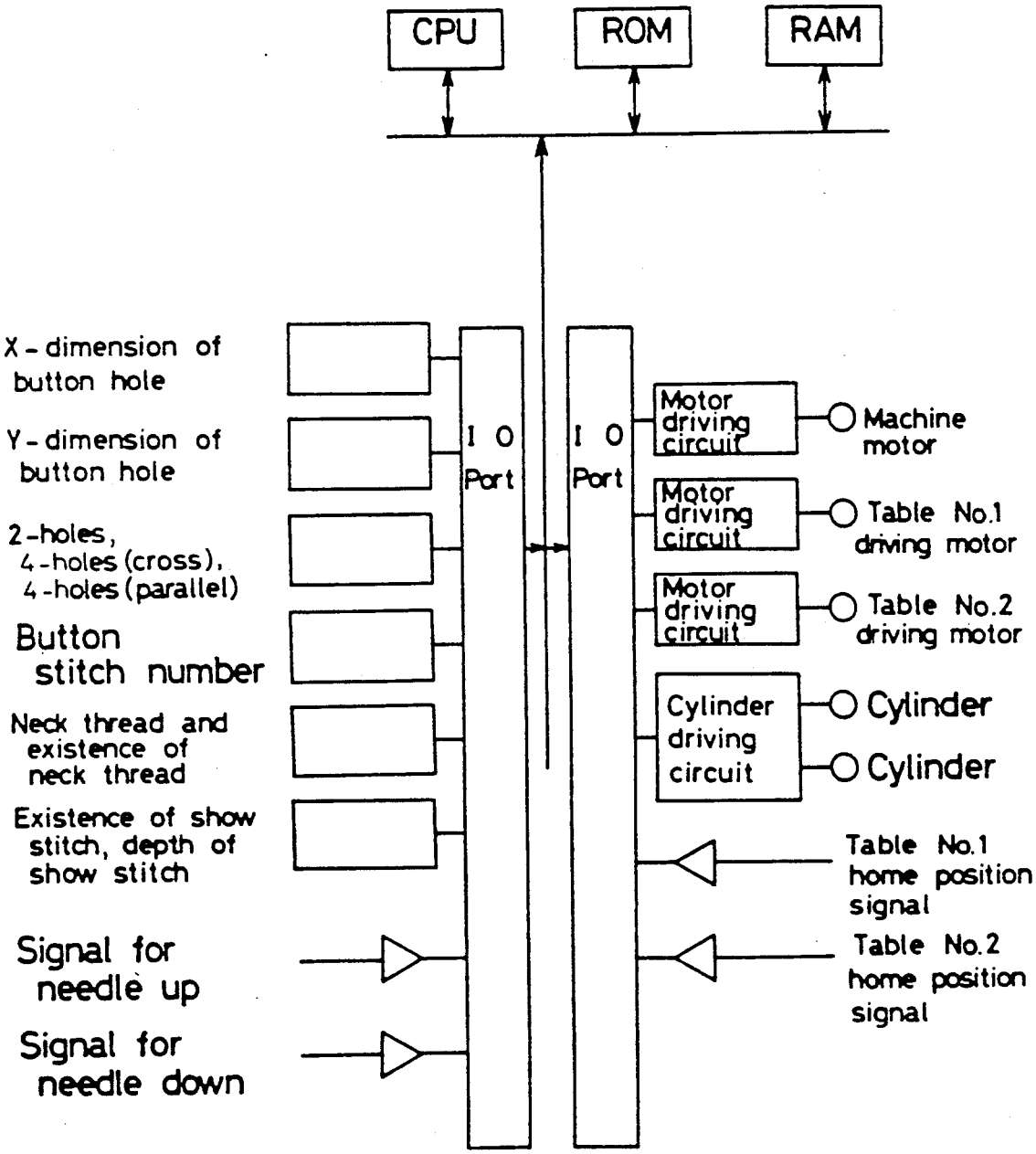
FIG. 12 is a schematic diagram of a program chart of the control apparatus for controlling the sewing machine according to the present invention.

The CPU (Central Processing Unit), as shown schematically in FIG. 12, reads the home position signals of Table Drive No. 1 and Table Drive No. 2 (the two table drives for X-Y table 5) via the IO port (Input/Output port) and determines the direction in which the table drives should move. Then, the CPU sends signals via the IO port to a motor driving circuit of the stepping motors for driving drive No. 1 and No. 2, whereby the X-Y table 5 moves. Again, the CPU reads the home position signals of drive No. 1 and drive No. 2 and moves the X-Y table 5. By repeating such an operation, the table drives move to the home positions and the CPU suspends such action.

During the above movement of the table, the CPU also reads signals indicative of whether the needle is up via the IO port and if it determines that the needle is not at the upper dead point, the above-described movement of the table drives is not carried out because there is concern about the possibility of the needle striking against the X-Y table 5 and the CPU thus assumes a watch-and-wait attitude.

Next, when buttons and sewing material are set and the button attaching operation is started, the CPU reads via the IO port set values of the X-dimension of a button hole, the Y-dimension of a button hole (button hole position data), button hole configuration data (2-holes, 4-holes [cross], 4-holes [parallel]), and the button stitch number, the neck thread (and the presence of neck thread), whether a show stitch is to be carried out, and the depth of such a show stitch (which alone or in combination constitute button hole pattern data). On the basis of these set values and the data on the ROM, the CPU provides values by which the table drives are to be moved to the RAM and also issues signals to the driving circuit for driving the sewing machine motor.

With the driving of the sewing machine motor, the sewing operations (button attaching and neck wrapping) start. A signal indicative of the needle being down is issued during each revolution of the sewing machine, and the CPU reads in such signals via the IO port. With the issuance of the signal indicative of the needle being down, the CPU sends a signal, on the basis of the value provided to the RAM, to the driving circuits via the IO port for operating the table driving motors.

When values on the RAM cease to exist, the sewing operation terminates and the CPU stops the sewing machine motor. Then, the CPU sends signals to cylinders which actuate thread cutting, thread tensioning, and the like.

Of course, as is understood, it is sometimes necessary that during the operation of attaching one button, the driving and stopping of a sewing machine motor are repeated several times, and the thread cutting, thread tensioning, and other steps are also repeated several times. In addition, there may be several kinds of cylinders for effecting material pressing, reversing of the button holders, and like operations.

This exemplary embodiment of Applicant's invention having been described, it will be readily apparent that many different embodiments may be made without departing from the spirit and scope of the invention. The invention is not limited to the above-described structure, but should be interpreted only in accordance with the appended claims.

What is claimed is:

1. A method of button sewing on and neck thread wrapping in a button sewing machine, comprising:

feeding a thread to a reciprocating needle;

releasably holding a piece of fabric material adjacent to the reciprocating needle;

releasably holding a button between the reciprocating needle and the piece of fabric material so that the button can be attached to the piece of material by the thread fed to the reciprocating needle;

moving the fabric material between respective positions relative to a needle at which the deep stitch and at least one shallow stitch are to be carried out;

selectively moving the releasably held button and fabric material in two directions orthogonal to the direction of reciprocating movement of the reciprocating needle for positioning the releasably held button at predetermined locations relative to the reciprocating needle;

electronically controlling the moving of the releasably held button and fabric material in the previous step by using an electronic control device which controls the moving of the button and fabric material based on pre-set button-hole position data, button configuration data, and button hole pattern data;

stitching the releasably held button on the piece of fabric with a selected number of the stitches formed by the above steps, thereby defining a neck thread between the button and the piece of fabric which attaches the button to the piece of fabric; and wrapping another thread around the neck thread.

2. A method as in claim 1, wherein the neck thread wrapping step includes rotating the button attached to the piece of fabric with the neck thread to a position at which the neck thread is exposed to the reciprocating needle, moving the piece of fabric and button attached thereto with the neck thread forward in the machine relative to the reciprocating needle so that a middle portion or the outside of the neck thread is wrapped with thread during such forward movement, and then rearward so that the outside or the middle portion of the neck thread is wrapped with thread during such rearward movement, and inserting a free end of the neck thread into the middle portion of the neck thread so as to form an end stitching that prevents fraying of the free end of the neck thread.

3. A button sewing on machine comprising:

fabric holding means for holding at least one piece of fabric material;

button holding means for releasably holding a button adjacent the piece of fabric material so that the button may be sewn to the piece of fabric material;

a sewing needle;

means for reciprocating said sewing needle and for feeding a thread thereto;

a table movable in first and second directions orthogonal to the reciprocating motion of said sewing needle;

a first motor attached to said table for moving said table in the first direction;

a second motor attached to said table for moving said table in the second direction;

a first cylinder operatively connected to said fabric holding means for positioning the fabric holding means relative to the sewing needle during a first stitch to set a position of a needle-drop point of said sewing needle during the first stitch;

adjusting means for establishing a second position of the needle-drop point of said sewing needle at and after the second stitch which second position is different from the position of the needle-drop point set during the first stitch, and for allowing said second position to be adjusted;

a second cylinder operatively connected to said button holding means for moving the button holding means between a first state in which a button releasably held thereby is substantially horizontal and a second state in which a button releasably held thereby is substantially vertical; and an electronic control device for operating each one of said first and said second motors.

4. A button sewing on and neck thread wrapping button sewing machine, comprising:

a reciprocable sewing needle for stitching a thread;

thread feeding means for feeding a thread to the sewing needle;

fabric holding means for releasably holding a piece of fabric material adjacent the sewing needle;

button holding means for releasably holding a button between the sewing needle and the piece of fabric material so that the button can be attached to the piece of material by the thread fed to the needle;

means for controlling the length of movement of the needle relative to the fabric held by said fabric holding means to establish the length of a deep stitch and a shallow stitch selectively used to attach the button to the piece of fabric material;

X-Y table means operatively connected to the fabric and the button holding means for moving the releasably held button and the fabric material in two directions orthogonal to the direction of reciprocating movement of the sewing needle for positioning the releasably held button at predetermined locations relative to the needle;

control means operatively connected to the X-Y table means for electronically controlling the moving of the releasably held button and the fabric material, said control means including an electronic control device which controls the moving of the X-Y table means based on pre-set button-hole position data, button configuration data, and button hole pattern data; and means for rotating the button, attached to the piece of fabric with a selected number of the stitches defining a neck thread, to a position at which the neck thread is exposed to the reciprocating needle, so that the neck thread can be wrapped with thread.

* * * * *